United States Patent [19]

Nishi et al.

[11] Patent Number: 4,919,736

[45] Date of Patent: Apr. 24, 1990

[54] ALUMINUM ALLOY FOR ABRASION RESISTANT DIE CASTINGS

[75] Inventors: Naomi Nishi; Yosuke Takahashi, both of Tokyo, Japan

[73] Assignee: Ryobi Limited, Hiroshima, Japan

[21] Appl. No.: 226,011

[22] Filed: Jul. 29, 1988

[30] Foreign Application Priority Data

Jul. 30, 1987 [JP] Japan ..... 62-188744

[51] Int. Cl.[5] ..... C22C 21/02

[52] U.S. Cl. ..... 148/416; 148/417; 148/438; 148/439

[58] Field of Search ..... 148/416–418, 148/438, 439; 420/530, 534, 537

[56] References Cited

U.S. PATENT DOCUMENTS 4,648,918 3/1987 Asano et al. ..... 148/417

*Primary Examiner*—R. Dean

*Attorney, Agent, or Firm*—Sughrue, Mion, Zinn, Macpeak & Seas

[57] ABSTRACT

An aluminum alloy for abrasion resistant die castings comprising by weight, 6.0 to 9.0% Cu, 0.5 to 2.0% Mn, 1.6 to 3.0% Fe, 3% or less Mg, together with 13.5 to 20.0% Si, 0.5% or less Ni, an inevitable impurity of 0.3% or less Sn, and the remainder being Al, prepared by crystallizing out primary Si crystals of Si and Al-Fe-Mn-Si compounds and by forming a solid solution with Cu and Mg in the alloy's matrix.

4 Claims, 3 Drawing Sheets x5000 x5000 x5000 x1500 x1500 x1500 x1500 x1500

ALUMINUM ALLOY FOR ABRASION RESISTANT DIE CASTINGS

FIELD OF THE INVENTION

This invention relates to an aluminum alloy for abrasion resistant die casting. More particularly, it relates to an aluminum alloy with excellent abrasion resistance and mechanical properties.

BACKGROUND OF THE INVENTION

Hypereutectic aluminum alloys containing, by weight, from 14 to 25% silicon have been widely used in sliding parts as die casting alloys having excellent abrasion resistance. Especially, 390 Alloy comprising by weight 16.0 to 18.0% Silicon(Si), 4.0 to 5.0% Copper(Cu), 0.45 to 0.65% Magnesium(Mg), 0.1% or less Zinc(Zn), 0.6 to 1.1% Iron(Fe), 0.1% or less Manganese(Mn), 0.02% or less Titanium(Ti), trace of Phosphorous(P), and the remainder being Aluminum(Al), is so highly resistant against abrasion that it is used as an aluminum engine block free from cast iron liners. The alloy disclosed in JP-B-No. 53-37810 (the term "JP-B" as used herein means an "examined Japanese patent publication") comprising by weight, 13.5 to 16.0% Si, 4.0 to 5.0% Cu, 0.5% or less Mg, 1.0% or less Zn, 1.3% or less Fe, 0.5% or less Mn, 0.05 to 0.1% P, 0.5% or less Nickel(Ni), 0.3% or less Tin(Sn), and the remainder being Al, is 390-Alloy based, in which the alloy's machinability is improved without considerably damaging its original abrasion resistance. The alloy is used in a broad field as housings of door closers, etc.

The alloy disclosed in JP-A-No. 60-2643 (the term "JP-A" as used herein means a published unexamined Japanese patent application) containing by weight, 5.0 to 22.5% Si, 5.5 to 10.5% Cu, 0.8 to 1.5% Fe, 0.85 to 1.5% Mg, 0.002 to 0.025% P, and the remainder being Al and inevitable impurities, is an aluminum alloy for die castings suitably used for sliding parts which work satisfactorily when used with either high- or low-viscosity lubricating oils.

The excellent abrasion resistances of the aforesaid 390 Alloy and the alloy disclosed in JP-B-No. 53-37810 have been attained by existing primary Si crystals. Therefore, an amount of Si is necessarily increased to improve abrasion resistance. Increasing the concentration of Si to 20 wt % or more, however, leads to higher casting temperature and brings about disadvantages such as shortening the mold life. Furthermore, increasing primary Si crystals leads to a lowering of machinability. It is therefore preferable to improve abrasion resistance without adding a large amount of Si.

SUMMARY OF THE INVENTION

The inventors have studied a solution for aforesaid problems and developed an aluminum alloy for abrasion resistant die casting comprising by weight, 6.0 to 9.0% Cu, 0.5 to 2.0% Mn, 1.6 to 3.0% Fe, 3% or less Mg, together with 13.5 to 20.0% Si, 0.5% or less Ni, inevitable impurities and the remainder being Al, with the hardness of the new alloy being increased by crystallizing out primary Si crystals and Al-Fe-Mn-Si compounds, and by forming a solid solution with Cu and Mg in the alloy's matrix.

DETAILED DESCRIPTION OF THE INVENTION

Figure 1:
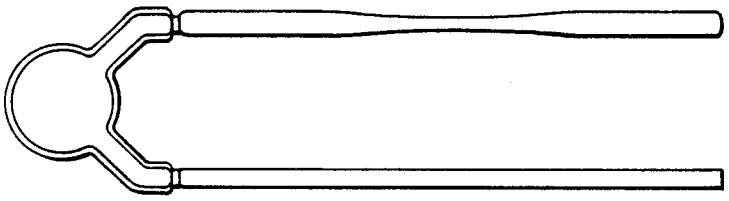
FIG. 1 shows the test pieces prepared with the alloy of the present invention.

The alloy composition of the present invention contains from 13.5 to 20.0% by weight of Si to give excellent castability and abrasion resistance. If the amount of Si is less than 13.5% by weight, the product would be deficient in primary Si crystals, and abrasion resistance would not be improved. If the addition is in excess of 20% by weight, the addition would leads to a rise in casting temperature, and the machinability of the alloy would therefore be adversely affected. The preferred range for Si is 15.2 to 17.5% by weight.

Copper forms a solid solution with Al to enhance the strength and improve the high temperature strength of the alloy. The addition of copper is desirably 5.9% by weight or more, however, addition in excess of 9.0% gives no apparent improvement in strength but adversely lowers the castability. Copper addition by weight is, therefore, desirably in the range from 6.0 to 9.0%, most preferably from 0.0 to 7.1%.

Addition of manganese leads to the formation of a massive Al-Fe-Mn-Si quaternary intermetallic compound having a hardness Hv of about 960. Though the hardness of the compound is lower than that of Si (Hv = 1,300), it contributes to the improvement of abrasion resistance. Too high an amount of Mn addition, on the other hand, forms a sludge during dissolution which settles on the bottom of the crucible. The amount of Mn addition by weight, therefore, should be 2% or less, preferably from 0.5 to 2%, most preferably 1.1 to 1.7%.

Iron avoids adhesion to a metal mould and also forms an Al-Fe-Mn-Si intermetallic compound which improves abrasion resistance. Iron should be added in an amount of 1.6% by weight or more to sufficiently give the aforesaid intermetallic compound. Addition of Fe in excess, however, adversely affects mechanical properties. The Fe content is desirably less than 3.0% by weight. Most preferably Fe addition is from 1.7 to 2.8% by weight.

Magnesium addition increases mechanical strength and hardens the alloy per se. However, too large an addition of magnesium adversely affects melt fluidity, and brittleness results. An addition of 3% by weight or less of magnesium gives satisfactory effects. Preferably Mg addition is from 1.0 to 2.2% by weight.

Nickel addition not only increases high temperature strength but also hardness. However, addition decreases corrosion resistance. Nickel addition is, desirably, 0.5% by weight or less, more preferably 0.1% by weight or less.

Zinc addition of 1.0% or less by weight gives satisfactory results. Preferred Zn addition is 0.1% by weight or less.

Tin is present as an inevitable impurity, but its content should be less than 0.3%.

Phosphorus is effective to make fine Si crystals. Fine Si crystals give good machinability and also improve mechanical properties. An addition of less than 0.001% by weight of phosphorus is insufficient to give fine crystals. An addition of more than 0.1% by weight, however, has no effect on the primary crystal size of Si. The addition of P is therefrom maintained in the range from 0.001 to 0.1% by weight. The preferred range for P addition is from 0.05 to 0/1% by weight.

The present invention is hereinafter described in greater detail with reference to examples, which are not to be construed as limiting the scope thereof. Unless otherwise indicated, all parts, percents and ratios are by weight.

EXAMPLE

Characteristics of the alloy of the present invention, the conventional 390 Alloy, and the alloy disclosed in JP-B-No. 53-37810 were evaluated. The methods and the results of the experiments are given below.

The experiments were performed on test pieces shown in FIG. 1 having the alloy compositions as listed in Table 1. A 90-ton die casting machine was used for casting. Casting conditions were as follows: temperature of 720° to 730° C., casting pressure of 760 kgf/cm$^2$, plunger tip speed of 1.35 to 1.40 m/sec, mold temperature of 120° to 140° C., and mold release time of 4 sec.

TABLE 1

| Alloy number | Alloy composition (wt %) | | | | | | | | | | | |
|---|---|---|---|---|---|---|---|---|---|---|---|---|
| | Si | Cu | Mg | Zn | Fe | Mn | Ni | Sn | Ti | P | Al | |
| 1 | 13.0 | 4.04 | 1.57 | 0.33 | 1.72 | 1.41 | 0.06 | 0.01 | — | 0.06 | Balance | Comparison |
| 2 | 14.6 | 5.40 | 1.44 | 0.28 | 1.78 | 1.44 | 0.08 | 0.02 | — | 0.07 | " | " |
| 3 | 15.2 | 5.99 | 1.86 | 0.34 | 1.79 | 1.45 | 0.06 | 0.02 | — | 0.08 | " | Invention |
| 4 | 15.0 | 6.70 | 1.25 | 0.38 | 1.82 | 1.46 | 0.07 | 0.02 | — | 0.07 | " | " |
| 5 | 15.5 | 6.79 | 3.04 | 0.40 | 1.77 | 1.48 | 0.08 | 0.02 | — | 0.07 | " | Comparison |
| 6 | 15.4 | 7.52 | 1.98 | 0.39 | 1.91 | 1.44 | 0.06 | 0.02 | — | 0.08 | " | Invention |
| 7 | 15.3 | 10.02 | 1.16 | 0.36 | 1.88 | 1.43 | 0.07 | 0.01 | — | 0.07 | " | Comparison |
| 8 | 17.5 | 7.03 | 1.02 | 0.12 | 1.98 | 1.15 | 0.03 | Tr | — | 0.06 | " | Invention |
| 9 | 15.6 | 7.12 | 1.24 | 0.39 | 0.68 | 0.41 | 0.08 | 0.02 | — | 0.05 | " | Comparison |
| 10 | 15.2 | 7.02 | 2.20 | .0.33 | 2.71 | 1.62 | 0.07 | 0.01 | — | 0.06 | " | Invention |
| 390 | 16.8 | 4.50 | 0.38 | 0.08 | 1.06 | 0.08 | Tr | Tr | 0.02 | Tr | " | Reference |
| JP-B-53-37810 | 14.6 | 4.85 | 0.44 | 0.29 | 0.72 | 0.33 | 0.08 | 002 | — | 0.07 | " | " |

(1) Castability

Each alloy composition of the present invention showed excellent castability free from run deficiency, scuffing, and seizure. When the Cu content is 10%, the run is more or less damaged.

(2) Casting structure

Figure 2A:
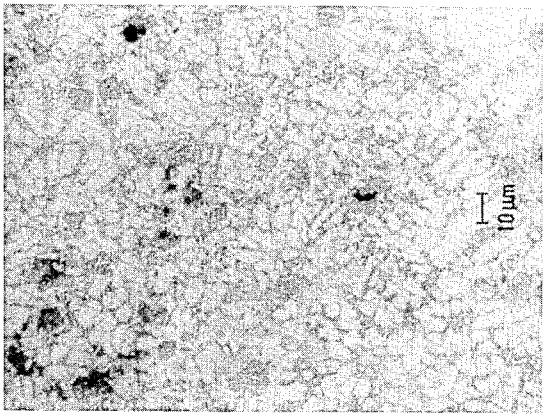
FIG. 2 shows micrographs, at 5,000 times magnification of the cast structures of the alloys; "a" is for the alloy of the present invention, "b" is for the 390 Alloy, and "c" is the alloy disclosed in JP-B-No. 53-37810.
Figure 2B:
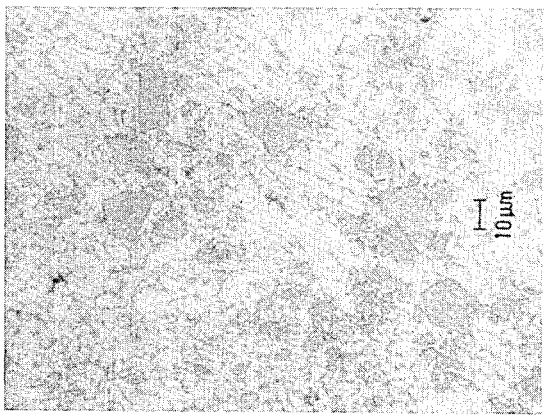
Figure 2C:
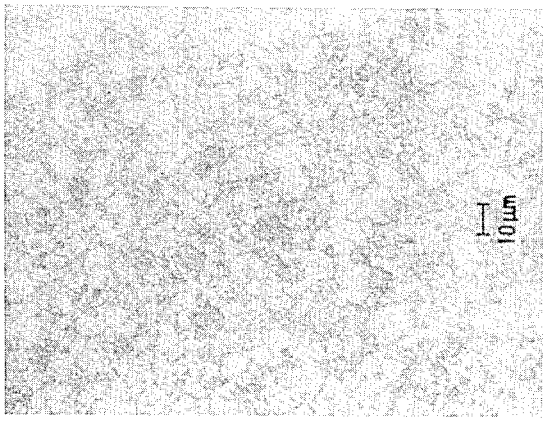
Figure 3A:
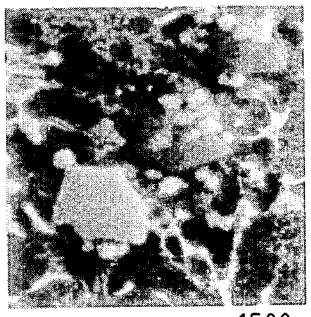
FIG. 3 shows the results of planar analyses by EPMA (Electron Probe Micro Analysis) for primary Si crystals and Al-Fe-Mn-Si quaternary intermetallic compounds at 1,500 times magnification, wherein a is the SEM (Seanning Electron Micrograph) image, and b, c, d, and e show the results with Al-K$\alpha$, Fe-K$\alpha$, Mn-K$\alpha$ and Si-K$\alpha$ radiations, respectively.
Figure 3D:
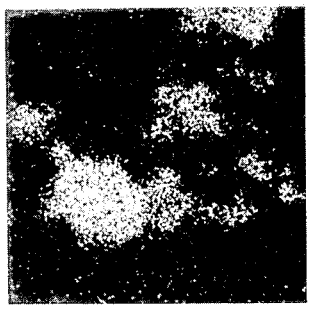
Figure 3B:
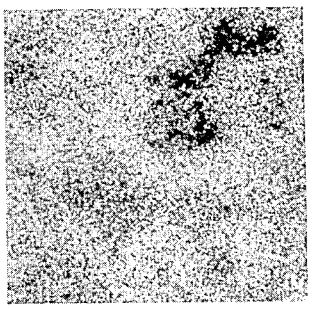
Figure 3E:
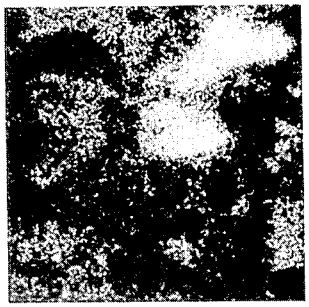
Figure 3C:
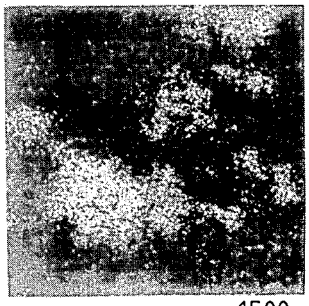

Casting structures for the die cast alloy of the present invention, 390 Alloy, and the alloy disclosed in JP-B-No. 53-37810 are given in FIG. 2. The test pieces were etched with an aqueous 5% HF solution. The casting structures of 390 Alloy and the alloy of JP-B-No. 53-37810 comprise primary Si crystals, dendritic and eutectic crystals of Si, and intermetallic compounds such as $CuAl_2$ and $Mg_2Si$. In 390 Alloy, dark gray granules are the primary Si crystals. The large granules deteriorate the machinability. In the alloy of JP-B-No. 53-37810, the granules are reduced in size so that the machinability is improved, however, the amount of the primary Si granules is decreased so that the hardness is lowered. The cast structure of the alloy of the present invention exhibits additional crystal deposition of Al-Si-Fe-Mn quaternary intermetallic compound. Light gray granules observed in the micrograph correspond to above crystals. The hardness, Hv, for the intermetallic compound is about 960, and is lower than that of Si (Hv=1,300), however, the compound highly contributes to improved abrasion resistance. Dendritic crystals are clearly observed as compared with 390 Alloy and the alloy of JP-B-No. 53-37810 since the Cu concentration of the former is larger than the latter two. The Cu concentration in the central part of the dendritic crystal measured by EPMA (Electron Probe Micro Analysis) gave about 1.1% and 1.0% by weight for 390 Alloy and the alloy of JP-B-No. 53-37810, respectively, in contrast to 1.4 to 1.8% by weight for the alloys of the present invention. Copper is therefore assumed to contribute to solid-solution strengthening.

FIG. 3 shows the EPMA result for the Al-Si-Fe-Mn quaternary intermetallic compound. The Scanning Electron Micrograph given in FIG. 3*a* reveals a mass nearly hexagonal in shape to be present at a lower left side thereof. EPMA analysis using Al-K$\alpha$ radiation (FIG. 3*b*) indicates that the massive part is low in Al, but is high in Fe and Mn as observed in analyses using Fe-K$\alpha$ (FIG. 3*c*) and Mn-K$\alpha$ (FIG. 3*d*). The analysis using Si-K$\alpha$ (FIG. 3*e*), shows that the massive part is slightly low in Si. The massive part is therefore identified as an Al-Si-Fe-Mn quaternary intermetallic compound. FIG. 3*d* indicates an extremely high Si concentration at the upper right of the micrograph.

(3) Mechanical Properties

Test pieces shown in FIG. 1 having the alloy compositions as listed in Table 1 were subjected to measurements of tensile strength, 0.2% yield strength, elongation, and hardness. The results are given in Table 2. The results are given with the average value of N(number of samples)=5.

a. Tensile test

The test pieces shown in FIG. 1 were subjected to tensile test at room temperature using a 10-ton tensile tester. The speed was 5 mm/sec. In both the tensile strength and the 0.2% yield strength, the higher the Cu content, the larger the result obtained. Both values keep approximately constant values at Cu contents of 6 to 7% or more. The tensile strength and the 0.2% yield strength of the alloy of the present invention are approximately 10% higher and 20% higher respectively than that of 330 Alloy or the alloy of JP-B-No. 53-37810. Elongation increases more or less with the addition of Mn, and is low when the Cu content is high. The elongation is the least for the alloy containing about 3% by weight of Cu.

b. Hardness

Hardness was measured on the surface of a rectangular test piece as shown in FIG. 1, being polished as far as about 1 mm in depth. A Rockwell hardness testing machine was employed and the measurement was performed based on the B scale. It was harder for a higher Cu content, and reached approximately a constant value in the range from 6 to 9% by weight of Cu. The hardness of the alloy of the present invention is about 10% higher than the conventional 390 Alloy, and about 20% higher than the alloy of JP-B-No. 53-37810.

(4) Abrasion Resistance

Abrasion tests were performed on the surface of the rectangular test pieces as shown in FIG. 1, being polished as far as about 1 mm in depth. The test pieces were subjected to abrasion tests using an Ogoshi-type abrasion test machine with a FC25 counter material, in a lubricating-oil free, dry condition.

The abrasion test results are given in Table 3. The results are given with an average value of N=5. Abrasion resistances are improved for those alloys having additional Mn or Fe. Abrasion resistance is higher at any velocity with a higher Cu content, and approaches approximately a constant value at 6 to 7% by weight of Cu, showing a tendency similar to those obtained in the tensile and hardness tests.

TABLE 2

| Alloy number | Mechanical Properties: Tensile Strength (kgf/mm$^2$) | 0.2% yield Strength (kgf/mm$^2$) | Elongation to Fracture (%) | Hardness ($H_RE$) | |
|---|---|---|---|---|---|
| 1 | 27.8 | 22.7 | 0.65 | 70.3 | Comparison |
| 2 | 29.0 | 24.2 | 0.48 | 75.5 | " |
| 3 | 30.5 | 26.2 | 0.31 | 83.5 | Invention |
| 4 | 31.4 | 28.1 | 0.30 | 84.9 | " |
| 5 | 31.0 | 28.3 | 0.29 | 85.2 | Comparison |
| 6 | 29.7 | 29.2 | 0.20 | 86.7 | Invention |
| 7 | 31.2 | 28.5 | 0.26 | 84.4 | Comparison |
| 8 | 31.0 | 30.1 | 0.38 | 83.7 | Invention |
| 9 | 29.4 | 27.8 | 0.40 | 80.6 | Comparison |
| 10 | 31.2 | 30.0 | 0.31 | 88.3 | Invention |
| 390 | 29.2 | 24.9 | 0.42 | 75.0 | Reference |
| JP-B-53-37810 | 28.2 | 23.9 | 0.38 | 71.9 | Reference |

TABLE 3

| Alloy number | Specific Abrasion × $10^{-7}$ mm$^2$/kg: 0.96 m/sec | 1.96 m/sec | 2.86 m/sec | 4.36 m/sec | |
|---|---|---|---|---|---|
| 1 | 31.5 | 30.2 | 31.2 | 34.0 | Comparison |
| 2 | 24.0 | 29.5 | 27.0 | 32.8 | " |
| 3 | 22.8 | 24.0 | 23.5 | 26.2 | Invention |
| 4 | 21.9 | 23.3 | 24.0 | 26.0 | " |
| 5 | 21.0 | 23.8 | 19.8 | 24.8 | Comparison |
| 6 | 23.0 | 23.5 | 19.4 | 22.7 | Invention |
| 7 | 21.5 | 20.8 | 22.4 | 24.0 | Comparison |
| 8 | 21.7 | 21.6 | 21.9 | 23.0 | Invention |
| 9 | 25.1 | 24.2 | 27.8 | 28.6 | Comparison |
| 10 | 19.3 | 18.7 | 19.4 | 21.8 | Invention |
| 390 | 23.6 | 25.3 | 23.8 | 26.1 | Reference |
| JP-A-53-37810 | 28.5 | 28.2 | 29.6 | 31.2 | Reference |

The above results are summarized as follows.

(1) The alloy has a good castability comparable to those of conventional alloys.

(2) The Cu solubility in the dendritic crystals is higher than in the conventional alloys wherein strength may be increased by solid-solution strengthening.

(3) Tensile strength, 0.2% yield strength, and hardness of the present alloy are all superior to those of the conventional 390 Alloy or to those of the alloy of JP-B-No. 53-37810.

(4) The abrasion resistance of the alloy of the present invention is superior to that of the alloy of JP-B-No. 53-37810 and is comparable to that of 390 Alloy.

While the invention has been described in detail and with reference to specific embodiments thereof, it will be apparent to one skilled in the art that various changes and modifications can be made therein without departing from the spirit and scope thereof.

What is claimed is:

1. An aluminum alloy for abrasion resistant die casts consisting essentially of by weight, 6.0 to 9.0% Cu, 0.5 to 2.0% Mn, 1.6 to 3.0% Fe, 3% or less Mg, together with 13.5 to 20.0% Si, 0.5% or less Ni, inevitable impurities and the remainder being Al, prepared by crystallizing out primary Si crystals of Si and Al-Fe-Mn-Si compounds, and by forming a solid solution with Cu and Mg in the alloy's matrix.

2. An aluminum alloy according to claim 1, wherein the inevitable impurities comprises 1.0% or less Zn and 0.3% or less Sn.

3. An aluminum alloy according to claim 1, which further comprises 0.001 to 0.1% P.

4. An aluminum alloy for abrasion resistant die casts consisting essentially of by weight, 6.0 to 7.1% Cu, 1.1 to 1.7% Mn, 1.7 to 2.8% Fe, 1.0 to 2.2% Mg, 0.4% or less Zn, and 0.05 to 0.1% P, together with 15.2 to 17.5% Si, 0.1% or less Ni, an impurity of 0.3% or less Sn, and the remainder being Al, prepared by crystallizing out primary Si crystals of Si and Al-Fe-Mn-Si compounds, and by forming a solid solution with Cu and Mg in the alloy's matrix.

* * * * *